United States Patent [19]

Laub

[11] 4,090,585

[45] May 23, 1978

[54] BALCONY FOR USE ON EXTERIOR WALLS OF BUILDINGS BELOW WINDOWS

[76] Inventor: Charles E. Laub, 32 Prices La., Staten Island, N.Y. 10314

[21] Appl. No.: 740,184

[22] Filed: Nov. 9, 1976

[51] Int. Cl.[2] ..... E04B 1/346; A62B 5/00; A62B 3/00

[52] U.S. Cl. ..... 182/47; 182/82; 182/113; 52/64

[58] Field of Search ..... 182/82, 84, 113, 47; 52/64

[56] References Cited

U.S. PATENT DOCUMENTS

| | | | |
|---|---|---|---|
| 285,740 | 9/1883 | Eyl | 182/84 |
| 292,767 | 1/1884 | Stevenson | 182/84 |
| 313,024 | 2/1885 | Putnam | 182/47 |
| 1,001,946 | 8/1911 | Gumm | 182/82 |
| 2,049,353 | 7/1936 | Cary | 182/113 |
| 2,888,299 | 5/1959 | Balogh | 182/113 |

*Primary Examiner*—Reinaldo P. Machado
*Attorney, Agent, or Firm*—George H. Mortimer

[57] ABSTRACT

A balcony for fire escape purposes for use below a window in an exterior wall of a multistory building which comprises support means to secure it in place on the wall; a platform secured to said means, preferably by spring hinges biasing it to horizontal position so that it can be removably held in vertical position against the wall or at right angles thereto; means secured to the support means for holding the platform in horizontal position against downward forces; an outside guard means secured to the platform parallel to and spaced from the connection thereof to the support means, preferably by spring hinges so that it is biased from a folded position against the platform to a position at right angles thereto; means operatively connected to the outside guard means and the support means to prevent the guard means from swinging beyond a right angular position with respect to the platform; an end guard means secured to each end of the outside guard means, preferably by spring hinges biasing them away from a folded position parallel to the outside guard means to an open position at right angles thereto; means operatively connected to the support means for limiting the movement of the end guard means beyond a right angular relation to the outside guard means while permitting movement toward the outside guard means against the force of the spring hinges; and means for releasably holding the parts in folded parallel relationship. The outside surface of the platform may be decorated to match or blend with the exterior wall to which it is attached and/or covered with a heat insulating material.

12 Claims, 6 Drawing Figures

BALCONY FOR USE ON EXTERIOR WALLS OF BUILDINGS BELOW WINDOWS

INTRODUCTION

The present invention relates to a balcony for fire escape purposes for use on exterior walls of buildings below windows. In the event of fire in a room or other interior part of a building, an occupant can escape by climbing out of the window onto the platform secured below it. The occupant is readily visible on the platform to fire fighters and can be brought down to the ground safely by means of a ladder.

BACKGROUND OF THE INVENTION

The need for balconies or platforms outside windows of multistory buildings has long been recognized. In general these platforms are of two kinds. One is a platform used by a worker for washing the outside of the window. This type of platform is readily removable and can be moved from window to window. The second type of balcony is for fire escape purposes.

An early proposed fire escape balcony is disclosed in Weaver U.S. Pat. No. 398479 of 1889 which was adapted to be secured in the window opening and which comprised a rectangular platform with a hinged joint through the middle parallel to the building, an outside guard means and an end guard means in the form of a lazy tongs. A lever was provided for folding the platform and drawing it in close to the building or for extending it in time of need. A ladder was secured to the building adjacent to the platforms so occupants of the building could step from the platform to the ladder and descend to the ground.

A later proposal is shown in Miller U.S. Pat. No. 1059062 of 1913 which provided a series of balconies secured to the exterior wall below each window in a vertical line of windows and which were connected by slides so the person in an upper floor could step out of the window onto the balcony, grasp a slide rod and descend to the balcony below it and so on to the ground.

There are also the familiar fire escapes comprising platforms secured to the exterior walls with connecting stairs to the second story (one story above ground level) and a vertically moveable ladder normally held at the level of the second floor platform and which can be lowered by a person on the second story platform to the ground level.

The proposed balconies and fire escape systems known to the prior art have many deficiencies and disadvantages. Among them are that they are unsightly, that they are relatively expensive to manufacture and install and that they cannot be made to blend with the appearance of the wall to which they are secured or to give a decorative affect to the building.

SUMMARY OF THE INVENTION

The present invention overcomes the difficulties and deficiencies of the prior art by providing a balcony adapted to be secured to the exterior wall of a building below a window which has an outside guard means and end guard means pivoted thereto to prevent a person on the platform from falling off. The end guard means can be swung inwardly to permit the occupant to step from the balcony to a ladder temporarily laid against the outside wall of the building by firefighters so that the person can descend to the ground from the platform.

Preferably the platform is hinged to support means adapted to be secured to the exterior wall of the building so that it can be raised from the horizontal position to a vertical position parallel to the exterior wall. The exposed wall of the platform can be decorated to match the outside surface of the exterior wall to which it is secured or to blend therewith and give an attractive decorative effect. This wall may also or alternatively be provided with a layer of heat insulating material, for example, of the same type of heat insulating material that is used on space ships to protect the ship from the heat produced by the friction of re-entry into the atmosphere. The outside guard means and the end guard means are also preferably pivoted or hinged together so that they can be folded against the platform and be concealed thereby when the platform is in the raised or vertical position. Preferably all of these hinged connections are resiliently biased, e.g., by spring hinges, to their open position and means are provided to hold or support them in the open position where they are at right angles to each other against further movement in the direction in which they have been moved to open them. Latch means may be provided in a convenient location releaseably to hold the device in the folded position but to release the parts to move to their open position in the event of a fire emergency.

The accompanying drawings illustrate a preferred embodiment of the invention in which.

DETAILED DESCRIPTION OF THE PREFERRED EMBODIMENT OF THE INVENTION

Figure 1:
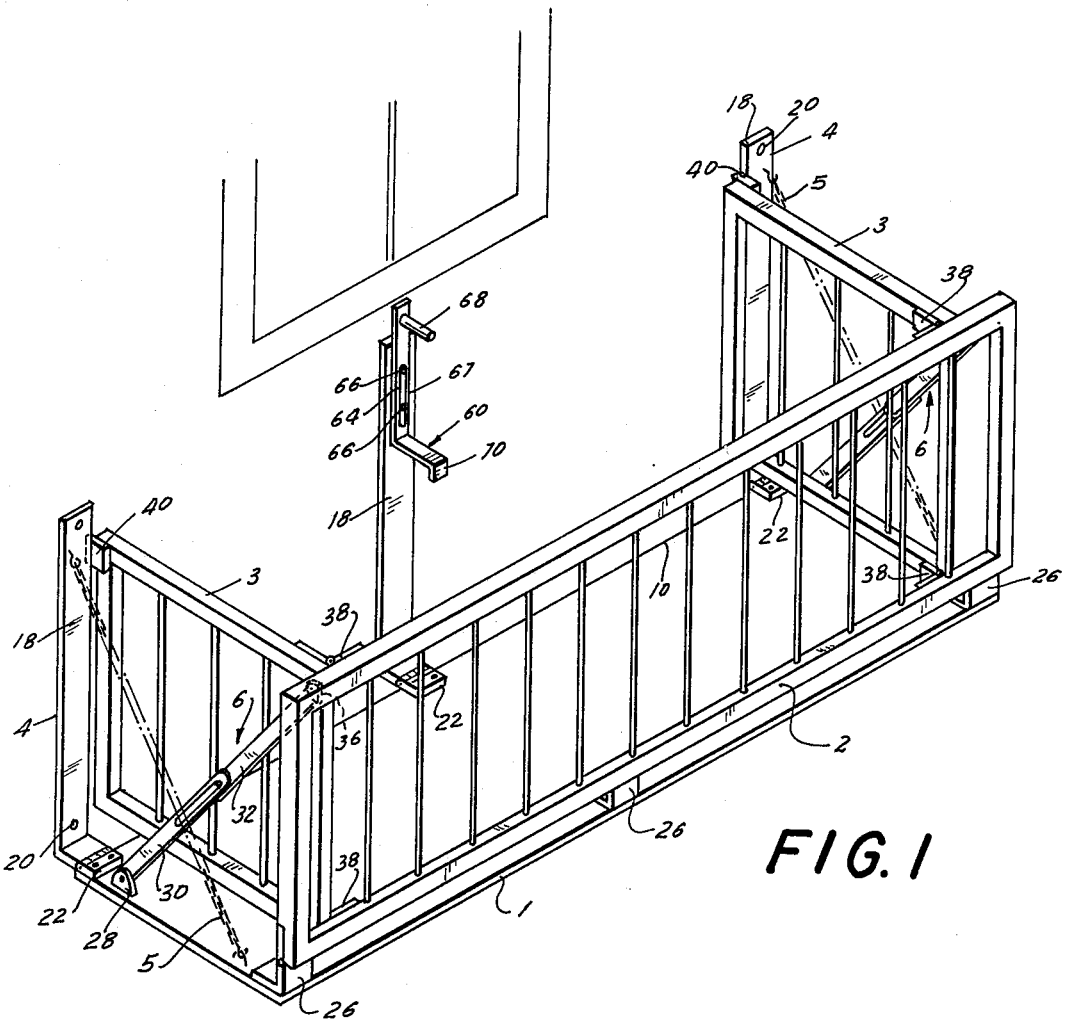
FIG. 1 is a perspective view of a balcony embodying the invention in the open position secured to an exterior wall of a building below a window are only fragmentarily shown.

Referring to FIG. 1, the balcony of the invention comprises a platform 1, an outside guard means 2, end guard means 3 at each end, support means 4 adapted to be secured to the exterior wall of a building below a window, means 5 to hold the platform 1 in horizontal position against downward force generated by the weight of the parts and by the weight of one or more persons standing on the platform 1, and means 6 to prevent outward movement of the outside guard means 2 beyond the right angular position with relation to the platform 1.

The platform 1 is preferably rectangular in shape comprising an inner edge 10, an outer edge 12 and end edges 14 and 16, respectively. The rectangular shape, however, is not essential and any other shape which lends itself to the principles of the invention described herein may be used but the rectangular shape is simpler, more economical and more attractive in appearance.

The support means 4 may have any desirable structure. A simple and effective support means comprises a plurality of metal bars 18 which may be secured to the wall by bolts 20 or the like. In the embodiment shown in FIG. 1, three such bars are provided and these have been found to be satisfactory in practice. The bars 18 are preferably bent outwardly at right angles at their lower ends to form part of or a support for a hinge 24 connected to the inner edge 10 of the platform. The part 22 is long enough to space the pivot point sufficiently far away from the support bars 4 to permit the end guard means 3 to be folded against the outside guard means 2 and these parts to be folded against the platform and then permit the platform to be rotated around the pivot points of the hinges 24 to the vertical position shown in FIG. 4 and FIG. 5.

Figure 3:
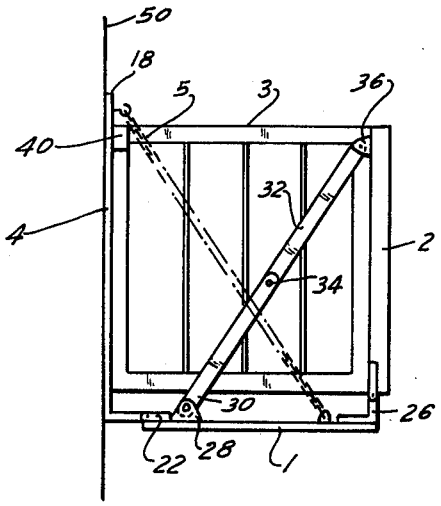
FIG. 3 is an end view of the platform of FIG. 1 in open position.

In order to support the platform against rotation beyond the horizontal position shown in FIGS. 1 and 3, suitable holding means 5, e.g., a link chain, may be provided which has one end connected to the support means 4 and the other end connected to the platform adjacent to its outer edge 12 and of such length as to hold the platform in right angular relation to the support means 4 in open position.

Figure 4:
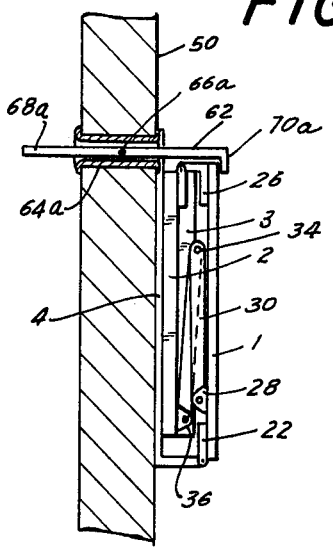
FIG. 4 is an end view of the platform of FIG. 1 in closed position.
Figure 5:
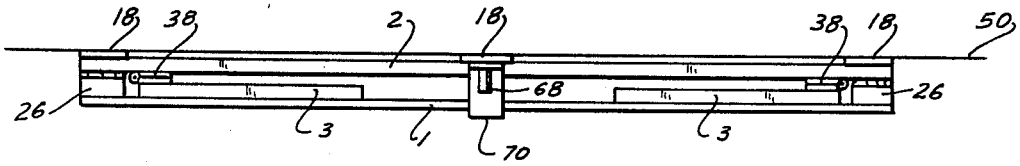
FIG. 5 is a top, planned view of the platform of FIG. 1 in folded position.

The outside guard means 2 is connected to the platform 1 along its outer edge 12. Preferably this connection is a pivotal connection which permits the outer guard means to be folded from a right angular position as shown in FIG. 1 to a parallel position with respect to the platform 1 as shown in FIGS. 4 and 5. This pivotal connection may be provided by a plurality of hinges 26 in which the half of the hinge secured to the platform is in the form of an angular bracket having a vertical leg, as seen in FIG. 1, long enough to place the pivot point a sufficient distance above the platform 1 to permit the outer guard means 2 and the end guard means 3 to be folded from the right angular position to a parallel position with respect to the platform 1.

In order to prevent the outside guard means 2 from moving beyond the right angular position as shown in FIGS. 1 and 3, a holding means 6 may be provided which has one end connected to the outside guard means adjacent to the upper end thereof as seen in FIG. 1 and with the opposite end operatively connected to the support means. In FIG. 1 the operative connection is provided by securing the lower end of the holding means 6 to the platform adjacent to the hinge 24 but this connection may be direct to the support means 4, as those skilled in the art will understand. The holding means 6, as shown in the preferred embodiment may comprise a bracket 28 secured to the platform 1 adjacent to the rear hinge 24 having a first bar 30 pivoted at one end to it, a second bar 30 pivoted at 34 to the first bar 30 at one end thereof and pivoted at the other end thereof to a bracket 36 secured to the outside guard means adjacent to the upper edge thereof, as best seen in FIGS. 1 and 3. This arrangement permits the holding means 6 to be folded from the extended position shown in FIGS. 1 and 3 to the folded position as shown in FIG. 4.

Figure 2:
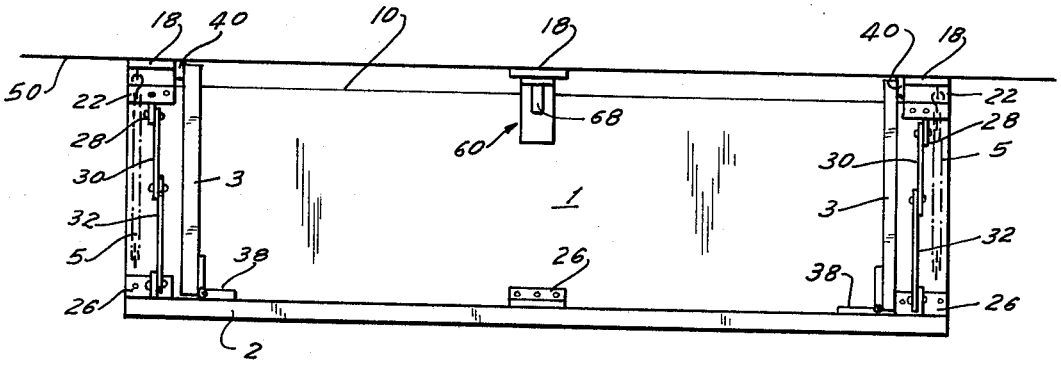
FIG. 2 is a plan view of the platform shown in FIG. 1 as seen from above.

The holding means 5 and 6 preferably are duplicated at each end of the platform as best seen in FIG. 2.

Each end guard means 3 is pivotally connected to the outside guard means 2 so as to be swingable from the right angular position shown in FIGS. 1, 2 and 3 to a folded position parallel and adjacent to the outside guard means 2 as illustrated in FIGS. 4 and 5. A suitable connection is by means of upper and lower hinges 38 as illustrated in FIGS. 1 and 2. In order to prevent the end guard means 3 from swinging beyond the right angular position shown in FIGS. 1 and 2, a stop means 40 may be provided in the form of a short bar welded or otherwise secured to the support means 4, as clearly illustrated in FIGS. 1 and 2. This permits either end guard means 3 to be swung inwardly from the right angular position as illustrated to a position adjacent and parallel to the outside guard means 2 and thereby permit a person on the platform to move from it onto a ladder temporarily placed against the building or in the vicinity of the end of the platform by a firefighter.

As illustrated in FIGS. 1 and 2, the end guard means 3 may be secured to the outside guard means 2 a sufficient distance inwardly from the right and left ends, respectively, of the outside guard means to give space for the holding means 5 and the holding means 6 beyond the end guard means 3. This arrangement does not interfere in any way with the opening of the end guard means 3 as a gate to permit a person on the platform to move from it and it is necessary for the person to step over only the relatively low height of the holding means 5 and 6 which is much easier to do than to climb over a fixed end guard means.

Figure 6:
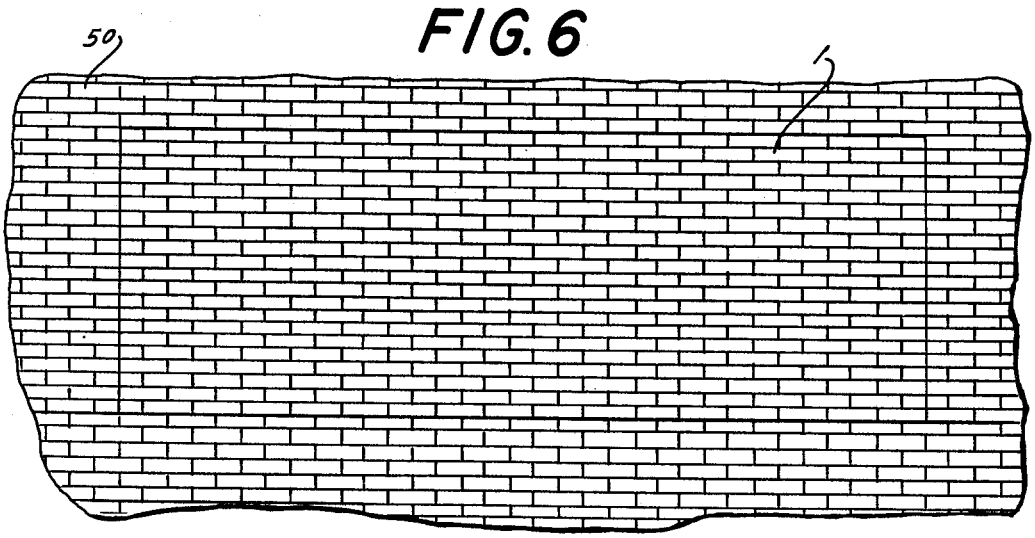
FIG. 6 is an elevation showing the exterior wall (fragmentarily) to which the balcony is secured in vertical or folded position and with the exposed surface decorated to conform with the exterior surface of the wall.

The normal position of the balcony or platform of the invention is the closed, or upright, position as illustrated in FIGS. 4, 5 and 6. One of the advantages of the invention is that the outside wall of the platform may be decorated to conform in appearance with the outside surface of the exterior wall. In the embodiment illustrated in FIG. 6, the fragmentary surface 50 of the exterior wall is a brick wall and the outside surface of the platform 1 is decorated to conform therewith in color and design. When the outside surface of the platform is thus decorated to conform with the outside surface of the exterior wall, the device becomes almost inconspicuous. Instead of decorating the outside surface of the platform to conform with the outside surface of the exterior wall to which it is attached, the two surfaces may be decorated so as to be contrasting and provide an interesting design for the exterior of the building to which the devices are attached. In any event, the balcony of the invention provides a pleasing appearance in the folded or upright position which does not detract from but which may actually add to the appearance of the building to which the platforms or balconies are secured. This is one of the outstanding advantages and benefits of the present invention.

Inasmuch as the folded or upright position of the balcony is not the position for use in emergency, it is advantageous to provide means for automatically moving the platform from the normal position to the useful position easily and quickly in the event of an emergency. In the embodiment of the invention illustrated in the drawings, this is accomplished by the use of resilient means which bias the various parts from the folded to the open position. Preferably this bias is provided by spring hinges for all of the parts. It is also necessary to provide releasable latch means for holding the platform in the folded or upright position and two embodiments of latch means are illustrated in the drawings for external or internal operation.

Referring to FIG. 1, the latch means 60 illustrated is for external operation and it comprises a bar of metal having an elongated slot 64 formed in a vertical portion thereof which can be slidably secured by headed bolts or rivets to the underlying metal support bar 18 in such a way that sufficient vertical motion is provided to permit a person using a handle 68 to lift it to move a hook 70 above the platform and thereby release it to be moved by the spring hinges to the open position which it will automatically occupy with the other parts moving from their parallel to their right angular positions, shown in FIG. 1.

The embodiment of the latch illustrated in FIG. 4 comprises a metallic bar 62a extending through the exterior wall which is provided with a tubular member 64a mounted in the wall and which is provided with a pivot 66a serving as a fulcrum for the bar 62a as a simple lever which can be moved up and down by the interior portion which forms a handle 68a to move the hook portion 70a from it engaging position as shown, to a disengaging position above the platform 1 when the handle is pushed downward and to re-engage it by moving the handle upwardly after the platform is raised to vertical position.

The embodiment of the invention illustrated in the drawing is the best embodiment presently known and embodies all of the advantages features which distinguish the invention over the prior art. It is not essential, however, that all of these features be combined in the platform because some of these features may be omitted and still provide a device which clearly distinguishes over the prior art and also provides a very useful article of manufacture. These various combinations of the desirable features of the present invention are set forth in the following claims, it being understood that further modifications and alterations may be made within the ambit of the present invention.

Having thus described and illustrated the invention what is claimed is:

1. A balcony comprising support means including two spaced metal bars adapted to be secured in upright position to an exterior wall of a building below a window, outwardly extending pivot mounting means at the lower ends of said bars, a platform pivotally connected to each of said pivot mounting means for movement to and from horizontal and vertical positions about a pivot axis spaced outwardly from the plane of said support means, said metal bars being about the same height as said platform in upright position with one being adjacent to one end of said platform and the other being adjacent to the other end thereof, means secured at one end to the upper ends of said metal bars and at the other end to said platform remote from said pivotal connection to hold said platform in said horizontal position against downward force, foldable guard means pivotally connected to said platform adapted to be folded against the upper surface thereof and to occupy the space between the support means and the platform when the platform is raised to vertical position, and means for removably latching said platform in raised vertical position.

2. A balcony as set forth in claim 1 in which said platform comprises a continuous plate having a heat resistant coating on the exposed wall when it is in vertical position.

3. A balcony as set forth in claim 1 in which said platform comprises a continuous plate having an exposed surface in vertical position simulating the wall to which it will be adjacent when secured to said wall.

4. A balcony as set forth in claim 1 which further comprises resilient means biasing said platform to horizontal position when released by said latching means.

5. A balcony as set forth in claim 1 in which said foldable guard means comprises an outside guard means pivoted to said platform remote from and generally parallel to its connection to said pivot mounting means so as to be movable to and from a vertical position and a horizontal position against the upper surface of said platform when said platform is in horizontal position, and means operatively connected to said support means to prevent further outward movement of said outside guard means.

6. A balcony as set forth in claim 5 which further comprises resilient means biasing said guard means to its vertical position with respect to the platform.

7. A balcony as set forth in claim 5 which further comprises an end guard means pivotally connected adjacent to an end of said outside guard means so as to be movable from a position against the inner surface thereof to a position at right angles thereto, and means connected to said support means for preventing movement of said end guard means beyond the right angular position thereof with respect to said outside guard means.

8. A balcony as set forth in claim 7 which further comprises resilient means biasing said end guard means to said right angular position.

9. A balcony as set forth in claim 7 which further comprises a second end guard means pivotally connected adjacent to the other end of said outside guard means and a second movement preventing means as defined for said first mentioned end guard means.

10. A balcony comprising support means including two spaced L-shaped metal bars each having a long leg adapted to be secured in upright position to an exterior wall of a building below a window and an outwardly extending short leg at the lower end, a rectangular platform having a spring hinge connection along one side to said short legs, a rectangular outside guard means having a spring hinge connection to the other side of said platform, an end guard means at each end of said outside guard means having a spring hinge connection thereto, means secured to the upper ends of said metal bars and to said platform remote from said hinge connection to hold said platform in horizontal position against downward force while permitting it to be raised to vertical position, means secured to said support means to prevent said outside guard means from moving beyond a right angular position with respect to said platform while permitting it to be folded parallel thereto, means secured to said support means to prevent said end guard means from movement beyond a right angular position with respect to said outside guard means while permitting said end guard means to be folded parallel to said outside guard means, and means for latching said platform in vertical position with said end guard means folded parallel to said outside guard means and said outside guard means folded parallel to said platform.

11. A balcony comprising a plurality of L-shaped metal bars each having a long leg adapted to be bolted in upright position to an exterior wall of a building and an outwardly extending short leg at the lower end, a rectangular metal platform having inner and outer sides connected along said inner side to said short legs by spring hinges which bias the platform to a position at right angles to the long legs of said bars, a rectangular outside guard means connected along one side to said outer side of said platform by spring hinges which bias the guard means to a position at right angles to said platform, an end guard means connected to each end of said outside guard means by spring hinges which bias them to a position at right angles to said outside guard means adjacent and parallel to the ends of said platform, means for holding said parts against movement beyond said right angular positions, and means for removably latching said parts in their parallel positions relative to the part to which they are respectively connected with said outside and end guard means in the space between the long legs of said metal bars and the platform provided by said short legs.

12. A fire escape balcony compising support means having upper and lower ends adapted to be secured to an exterior wall of a building below a window, a platform pivotally connected along an inner edge to the lower end of said support means by platform spacing means to provide a space between said support means and said platform when they are in parallel relation, guard means comprising outer guard means pivotally secured to said platform along an outer edge opposite said inner edge and end guard means pivotally secured to said outer guard means adapted in open position to be positioned along each end edge of said platform, means connecting the upper end of said support means to said platform remote from said pivotal connection permitting it to be held in right angular relation to said support means and to be folded to said spaced parallel relation to said support means to provide space for said guard means in folded position of the platform and guard means, means connecting the ends of said outer guard means remote from said connection to said platform to said balcony adjacent to the pivotal connection between said support means and said platform to hold said outer guard means against outward movement beyond said right angular relation, stop means on said support means for preventing movement of said end guard means beyond said right angular relation while permitting them to be freely pivoted inwardly, and means for biasing the movable parts to and removably holding them in right angular relation to the part in which each is connected.

* * * * *